United States Patent [19]

Cook et al.

[11] Patent Number: 4,619,726

[45] Date of Patent: Oct. 28, 1986

[54] LABEL APPLICATOR

[75] Inventors: Stephen F. Cook, Westfield; Harland S. Fisher, Longmeadow; Theodore E. Kosciuczyk, Worcester, all of Mass.

[73] Assignee: Westvaco Corporation, New York, N.Y.

[21] Appl. No.: 733,323

[22] Filed: May 13, 1985

[51] Int. Cl.[4] ..... B65C 9/02; B65C 9/10; B65C 9/14

[52] U.S. Cl. ..... 156/366; 156/568; 156/571; 156/578; 156/DIG. 25; 156/DIG. 29; 156/DIG. 31; 156/DIG. 35; 271/100; 271/107; 271/132; 271/276

[58] Field of Search ..... 156/568, 570, 571, 572, 156/578, DIG. 25, 329, 131, 364, 366, DIG. 35; 271/11, 12, 100, 107, 132, 276

[56] References Cited

U.S. PATENT DOCUMENTS

| | | | |
|---|---|---|---|
| 3,464,871 | 9/1969 | Smith | 156/568 |
| 3,607,579 | 9/1971 | Enskat et al. | 156/571 |
| 3,659,838 | 5/1972 | Davis | 271/107 |
| 3,864,187 | 2/1975 | Carter | 156/571 |
| 3,883,385 | 5/1975 | Kirk et al. | 156/568 |
| 3,945,878 | 3/1976 | Hubschmitt | 156/539 |
| 4,025,382 | 5/1977 | Del Rosso | 156/497 |
| 4,071,234 | 1/1978 | Schick | 271/100 |
| 4,289,562 | 9/1981 | Chisolm | 156/364 |
| 4,293,365 | 10/1981 | Geyser et al. | 156/364 |
| 4,352,710 | 10/1982 | Makley | 156/384 |
| 4,493,744 | 1/1985 | Voltmer et al. | 271/107 |

*Primary Examiner*—Michael Wityshyn
*Attorney, Agent, or Firm*—R. L. Schmalz; W. A. Marcontell

[57] ABSTRACT

A machine design is taught for automatically applying adhesive coated labels to folded cartons at a precisely adjusted location on a carton. Both labels and cartons are supplied singularly from bottom feed magazines. A cam oscillated vacuum picker curls one end of a label out of the magazine to be vacuum gripped to the peripheral surface of a rotating transfer drum. Continued rotation of the drum withdraws the remainder of the label from the magazine stack bottom and lays it to the drum periphery surface. A singular carton is slidably removed from the bottom of a respective magazine stack by a lugged conveyor belt and pushed into a timed nip proximity with the label carrying transfer drum. Between the label receiving and delivery positions, the label is carried past a fountain roll for surface coating of water or adhesive.

10 Claims, 11 Drawing Figures

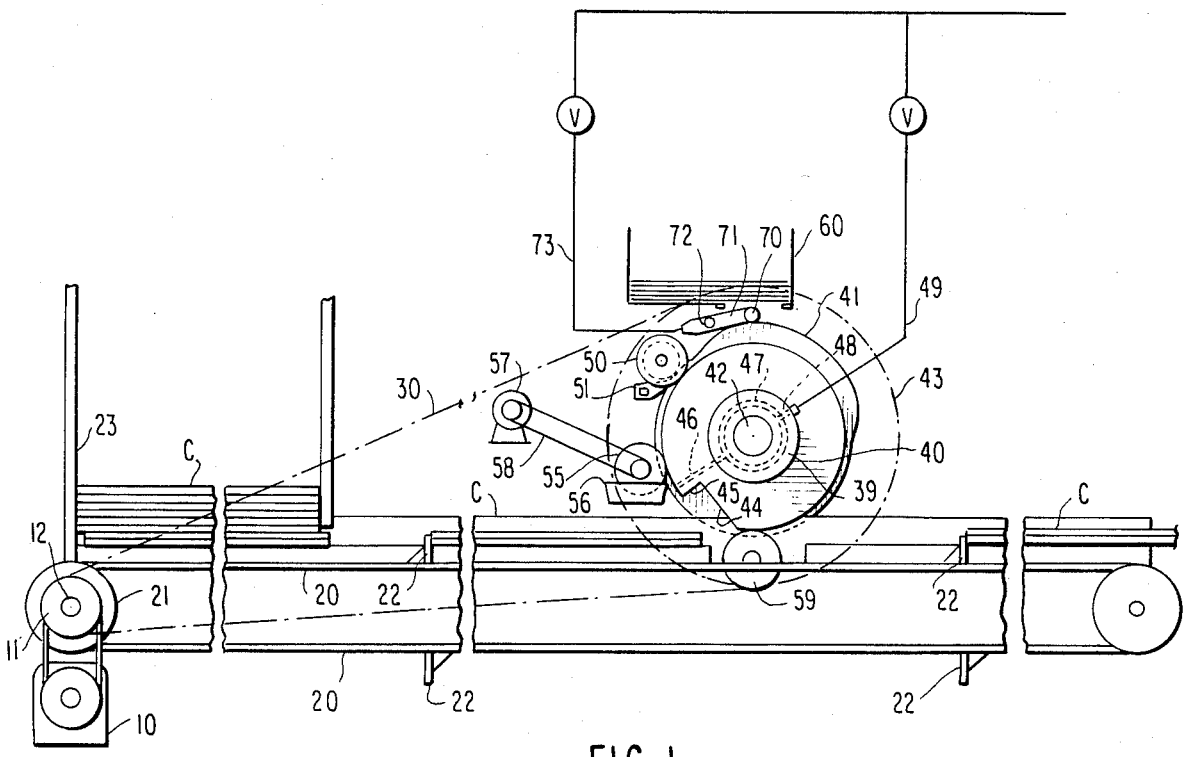
FIG. 1
FIG. 3
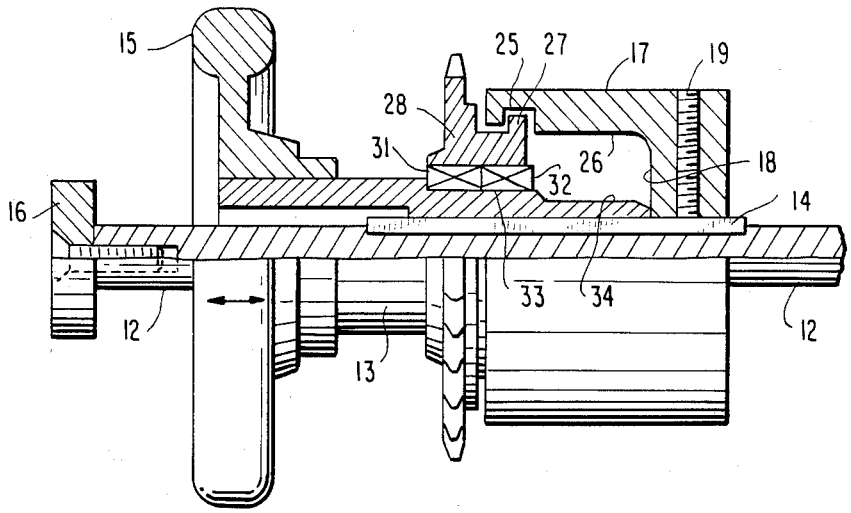

LABEL APPLICATOR

BACKGROUND OF THE INVENTION

1. Field of the Invention

The present invention relates to the art of automatically or mechanically packaging articles of commerce. More particularly, the invention comprises a machine for automatic application of adhesive coated labels to folded cartons or boxes.

2. Prior Art

Staples of commerce such as envelopes and packages of letter-sized paper are unitized in cartons or boxes for final shipment to a specific distributor or large order consumer. The number of such final shipment cartons of a particular article to a particular destination may range from a few score to several thousand. Each such carton must be labeled as to contents and addressee.

Although the prior art is well acquainted with large and complex label application equipment suitable for continuously labeling many thousands of cartons daily with the same information, small, simplified equipment economically capable of short production runs at low to intermediate production rates is either unavailable or unsatisfactory.

To the degree that suitably productive equipment is available for the task defined, such equipment is designed to handle labels with pressure sensitive contact adhesive. Such labels are secured to adhesive protection tapes which must be separated from the label prior to application. Comparatively, contact adhesive labels are several times more expensive than moisture activated pre-gummed labels or fountain roll applied liquid adhesive. High-speed continuous production equipment applies a coating of liquid adhesive to the label backside by the machine immediately prior to placement of the label on a respective carton.

It is, therefore, an objective of this invention to provide a machine for automatic placement of water moistened, pre-gummed labels at a precisely selected position on folded boxes or cartons.

Another objective of this invention is to provide a highly simplified, rotary mechanism for transfer of pre-gummed labels from a magazine box to a carton flap.

Another objective of this invention is to provide a simplified and inexpensive coordinate timing mechanism between a rotary transfer mechanism and a lugged feed belt.

Another objective of this invention is to provide highly effective and equally inexpensive timing clutch mechanism for coordinating the operation between two rotary mechanisms driven from a common drive source.

SUMMARY

These and other objectives of the invention are obtained by a rotating wheel label application mechanism that turns in timed relation with a lugged conveyor feed mechanism. The conveyor driven carton enters a nip between the carton and the rotating label transfer wheel. The precise placement position for the label on the carton arrives at the nip simultaneously with the transfer wheel perimeter carried label. Such timing between the conveyor and transfer wheel is manually coordinated for various carton sizes by a uniquely simple power transfer clutch.

One end of a single label is drawn from a bottom feed magazine stack by an oscillating vacuum bar picker and curled into contact with the rotating transfer wheel perimeter. A surface notch along the wheel perimeter engages the label end to further the initial end curl into a label face reversal against the wheel perimeter. As transfer wheel rotation continues, the reverse curled label end pulls out of the wheel perimeter notch to be gripped by a vacuum line on the wheel rotatively behind the notch edge. So gripped, the remainder of the label is drawn over the picker bar and out of the magazine into surface layment against the wheel perimeter. In the rotational arc between receipt of the label from the picker bar and the carton delivery position the label is carried past a fountain roll to be coated with adhesive or water; the latter in the case of labels that were previously coated with a moisture activated adhesive.

DESCRIPTION OF THE DRAWINGS

Relative to the several figures of the drawings wherein like reference characters designate like or similar elements:

FIG. 1 is a simplified elevational view of the invention showing the major functional constituents in the absence of framework and support structure.

FIG. 3 is a quarter sectioned detail of the timing clutch mechanism.

DESCRIPTION OF THE PREFERRED EMBODIMENT

Figure 2:
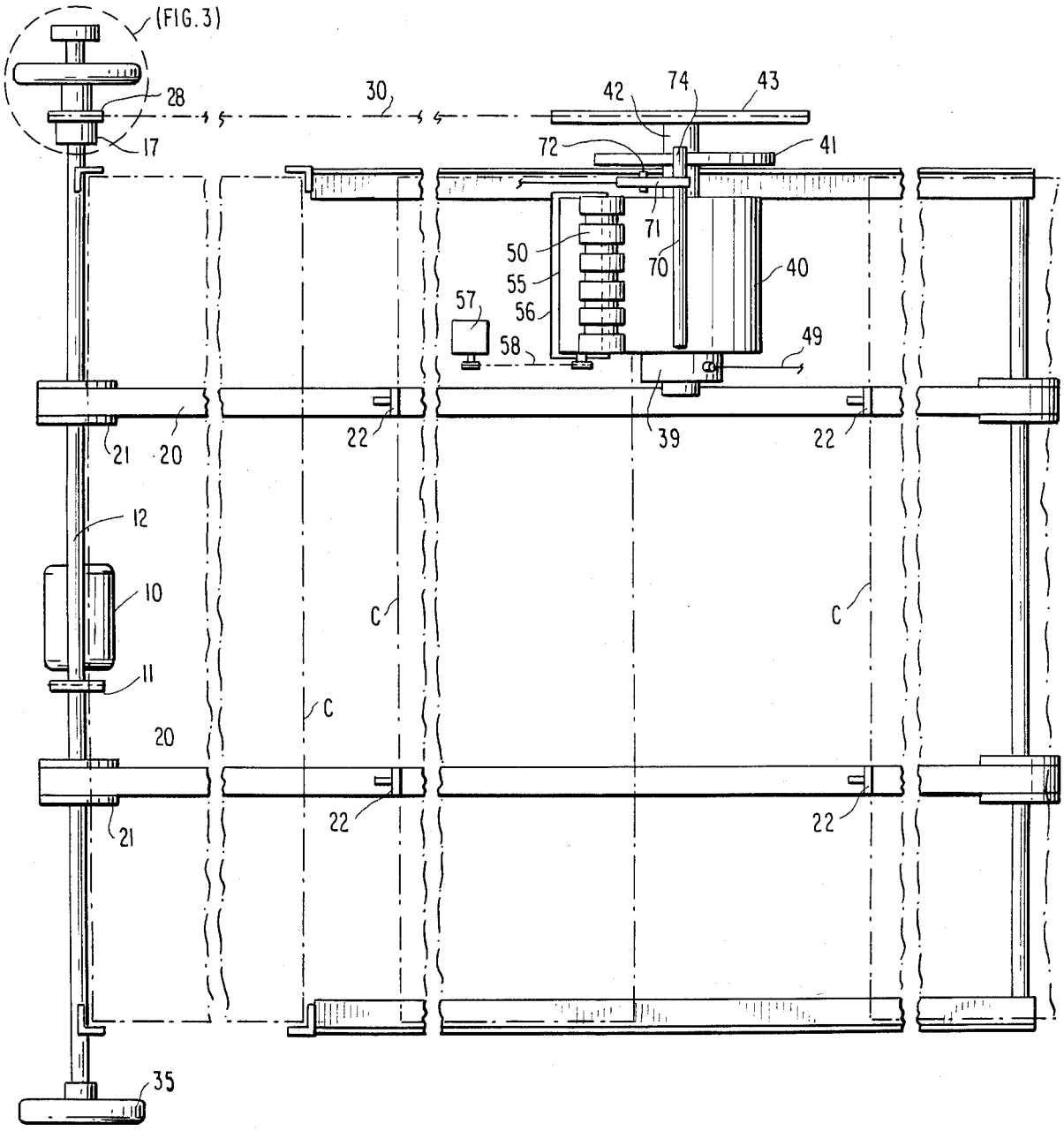
FIG. 2 is a simplified plan view of the invention showing the major functional constituents in the absence of framework and without the label supply magazine.

The general organization of the present invention comprises a rotating transfer applicator mechanism and a conveyor feed mechanism. These are operatively coordinated from a common drive shaft with a manually set power transfer clutch. Relative to FIGS. 1 and 2, both mechanisms are driven by motor 10 which is drive connected by chain and sprocket transmission 11 to a drive shaft 12.

The conveyor feed mechanism comprises belts 20 which are driven directly by drive sheaves 21 keyed to a main drive shaft 12. Lugs 22 for pushing a folded carton under the label transfer mechanism are secured to the belts 20 at equally spaced positions around the belt perimeters.

Rotary power take-off from the drive shaft 12 to the label transfer mechanism is angularly adjusted relative to the shaft rotational angle by the clutch arrangement of detail FIG. 3. Included is a key splined collar shaft 13 that is concentric with but axially slidable over drive shaft 12. A rotary drive key 14 connects the two rotatively. At the outboard end of the collar shaft 13 is a push-pull wheel handle 15 for manually moving the collar shaft between axial travel limits. Abutment wheel 16 is immovably secured to the end of drive shaft 12 to limit axial displacement of the collar shaft 13 toward the shaft end. Internal face 18 of the sprocket cage 17 limits in-board axial movement of the collar shaft 13. One or more set screws 19 secure the key 14 and sprocket cage in a fixed axial position along the length of the drive shaft 12.

An annular groove 25 within the internal bore 26 of the sprocket cage 17 loosely receives a circular caging shoulder 27 of sprocket hub 28 which drives the label transfer mechanism with chain 30.

Secured to the internal bore of sprocket hub 28 are two one-way drive clutches 31 and 32. Such machine components are also known as sprag clutches, over-running clutches and roller bearing clutches. In the present application, the two one-way clutches are set with opposite-hand orientation so that when engaged with the drive surface 33 of the collar shaft 13 no relative rotation between the collar shaft 13 and the sprocket hub 28 will occur in either direction. However, when the axially slidable collar shaft 13 is manually drawn against the outboard limit stop at abutment wheel 16 the smaller diameter radius of disengagement surface 34 aligns with the planes of clutches 31 and 33 to rotatively disengage the sprocket hub 28 from the collar shaft 13 and the drive shaft 12. In this condition, the drive shaft 12 may be rotated manually by hand wheel 35 for displacement of the belt lugs 21 in either direction independently of the label applicator drive. By this means, the carton driving lugs 21 may be precisely timed with that increment of the label placement cycle as to place a single label at the exact desired location of a given carton size and shape.

Folded cartons C are stacked in a magazine frame 23 for bottom stack withdrawal by the belt lugs 22. Adjustable front gating structure on the magazine frame allows only the single, bottom-most carton to be drawn from under the stack. Lugs 22 are sized to project less than a single carton thickness into the magazine bottom space.

The label transfer mechanism predominately comprises the label applicator drum or wheel 40 and label picker cam 41 which are both mounted on shaft 42 with drive sprocket 43 to be rotatively driven by chain 30. The circumference of applicator drum 40 matches the separation distance between lugs 22 so that one revolution of the applicator drum corresponds to the passage of one carton.

Essential details of the applicator drum 40 include a label inverting notch 44 which extends along the drum surface length parallel with the drum rotational axis. Rotatively behind the notch abutment face 45 are a series of drilled vacuum ports 46 aligned parallel with the abutment edge. These several vacuum ports are linked at the drum surface with a slot and near the drum center bore with a common porting channel to the outer radial face of the drum. A non-rotating slip ring 39 mounted on shaft 42 is provided with a circular face channel 47 at a radial position to communicate with the drum face outlet of the vacuum porting channel. A radial channel 48 in the slip ring 46 opens into an external vacuum conduit 49.

Associated with the applicator drum 40 is a slotted pressure roll 50 in light pressure rolling contact with the surface of drum 40. Stripper fingers 51 project into the pressure roll slots to prevent the transfer of a label from the applicator drum surface onto the pressure roll surface at a point prior to being wiped into secure contact with the applicator roll surface.

In near contact with the applicator roll surface is a fountain roll 55 having a lower chord portion immersed in a pan reservoir 56 which may contain water or liquid adhesive. Fountain roll 55 is independently driven by motor 57 and belt transmission 58.

Radially opposite from that point at which the applicator roll lays the leading edge of a label to a carton surface is a pressure roll 59. The pressure roll is resiliently biased against the applicator roll to provide firm adhesion pressure between the carton and the label.

Figure 4:
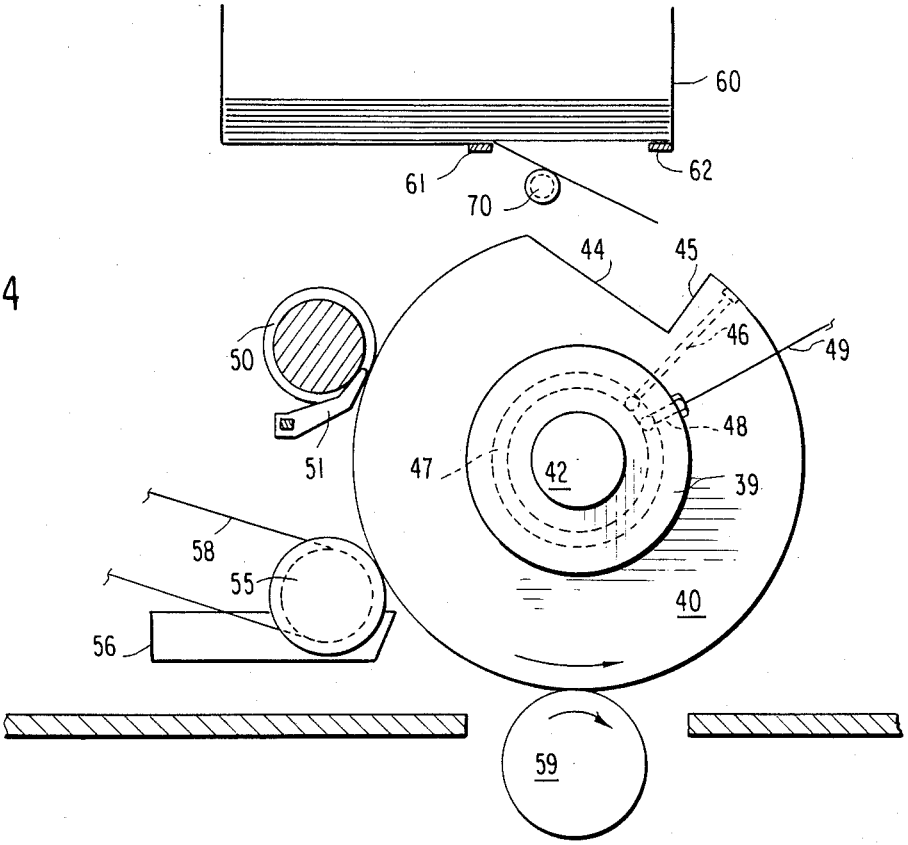
FIGS. 4–11 sequentially illustrate the label transfer mechanism operation.

Above the applicator roll is a label magazine 60 having two bottom ledges 61 and 62. An absence of bottom structure is provided in the space between the bottom ledges so that one end of the bottom-most label may be drawn therethrough as illustrated by FIG. 4. Oscillating against the magazine bottom and a short distance therefrom within the open bottom area of the magazine is a vacuum picker bar 70. The picker bar is an evacuated chamber having a slot or axially aligned series of holes through the chamber wall to grip a line portion of the bottom-most label in magazine 60 by vacuum pressure differential. The picker bar 70 is carried by a conduit arm 71 which oscillates about structural axis 72. An air conduit through the arm 71 is connected to an external vacuum source by tubing 73. Cam following portion 74 of the picker bar assembly rides the surface of picker cam 41 to regulate the positional timing of the picker bar relative to the angular position of applicator drum 40.

Figure 5:
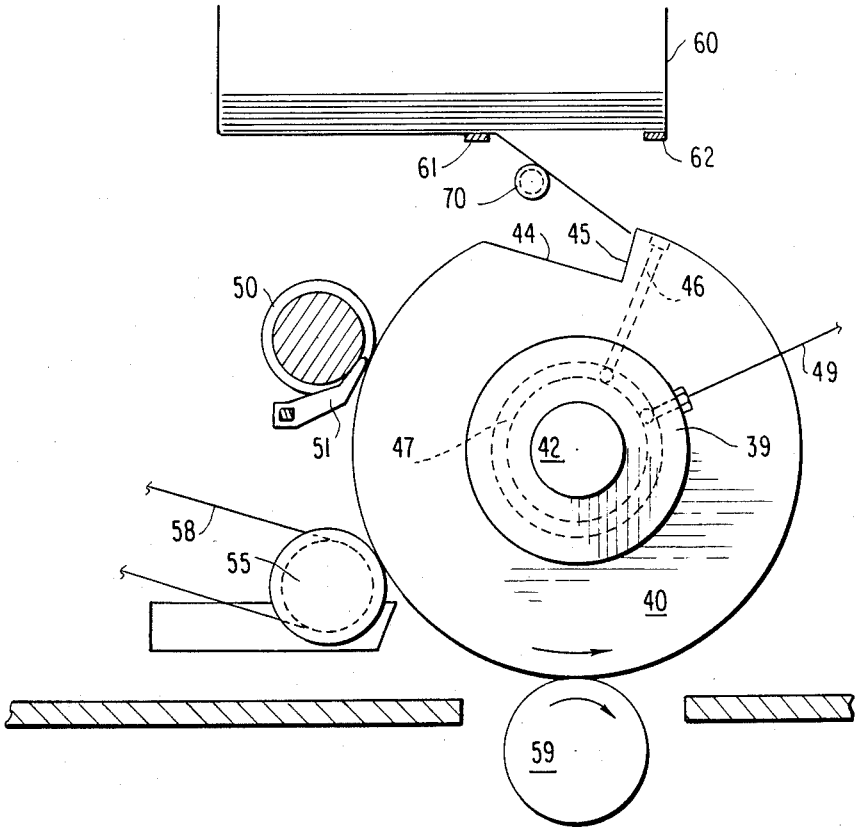
Figure 6:
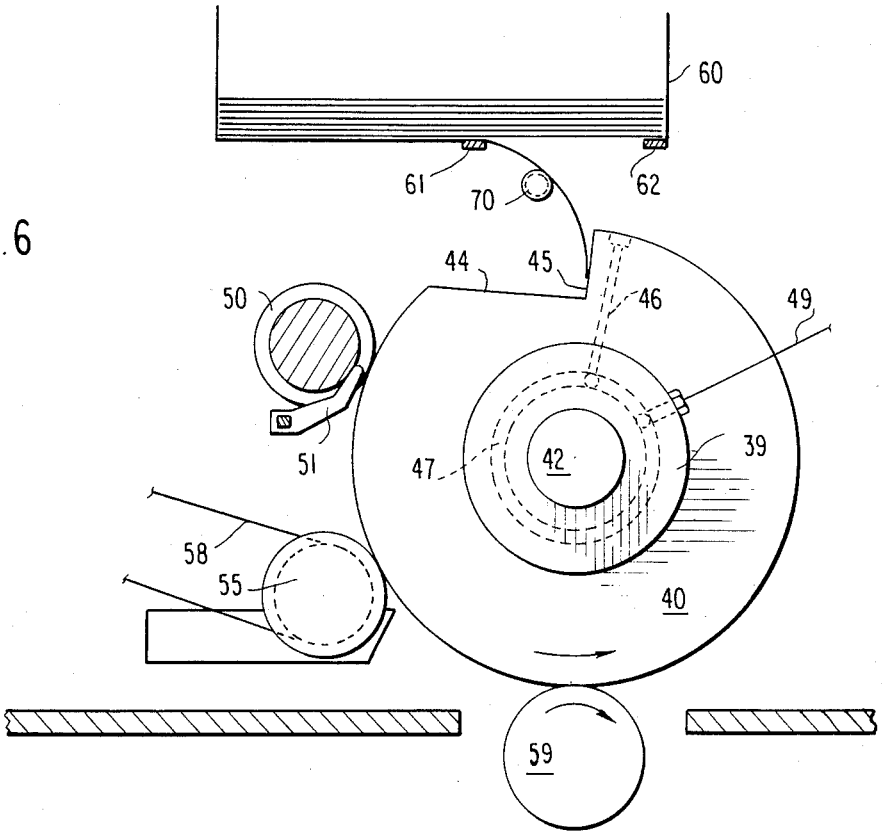
Figure 7:
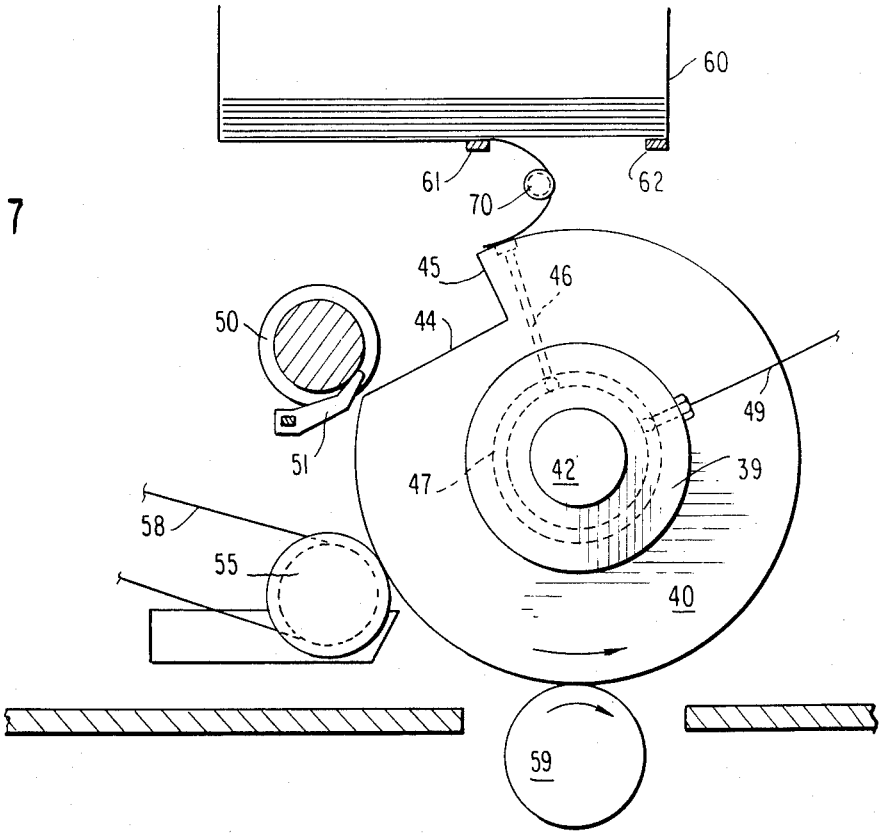
Figure 8:
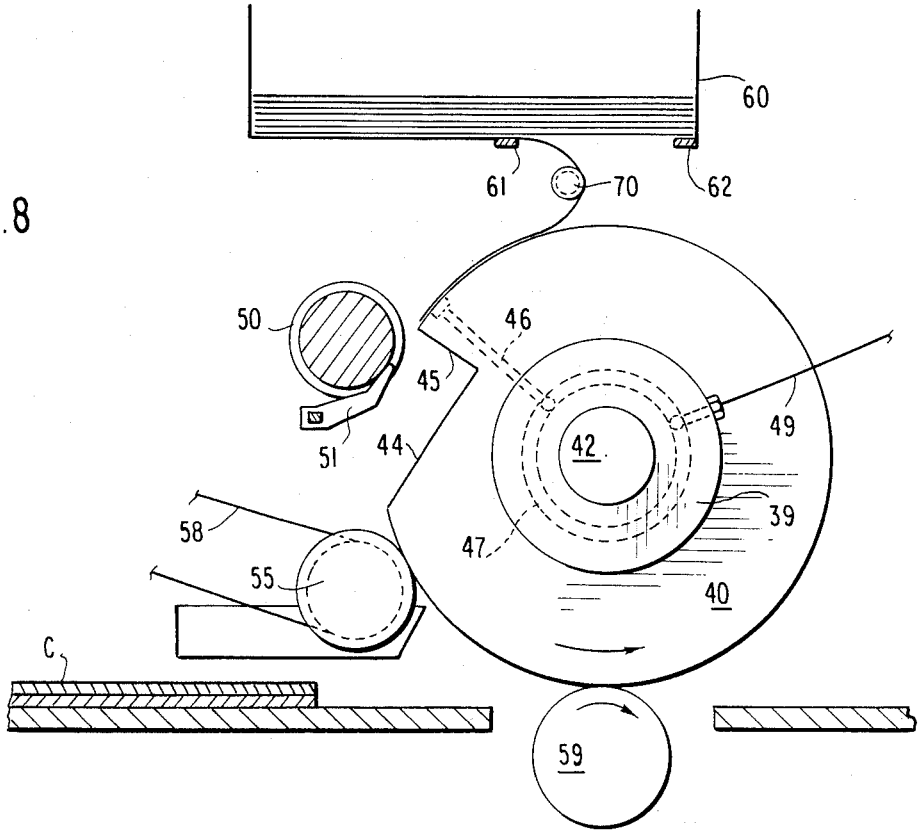
Figure 9:
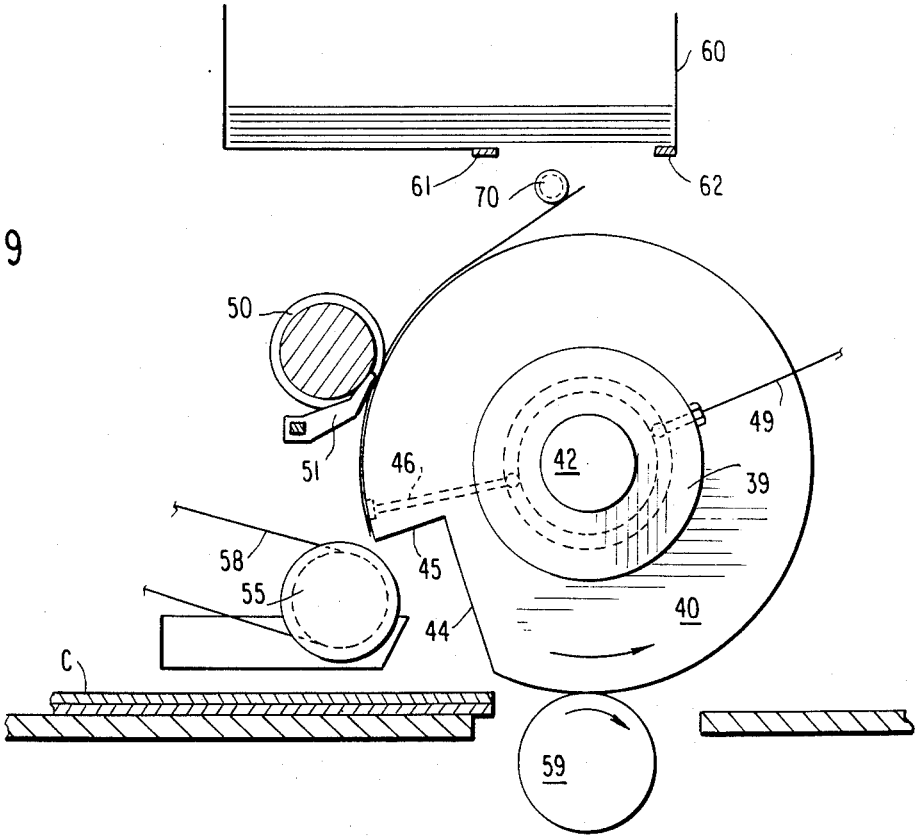
Figure 10:
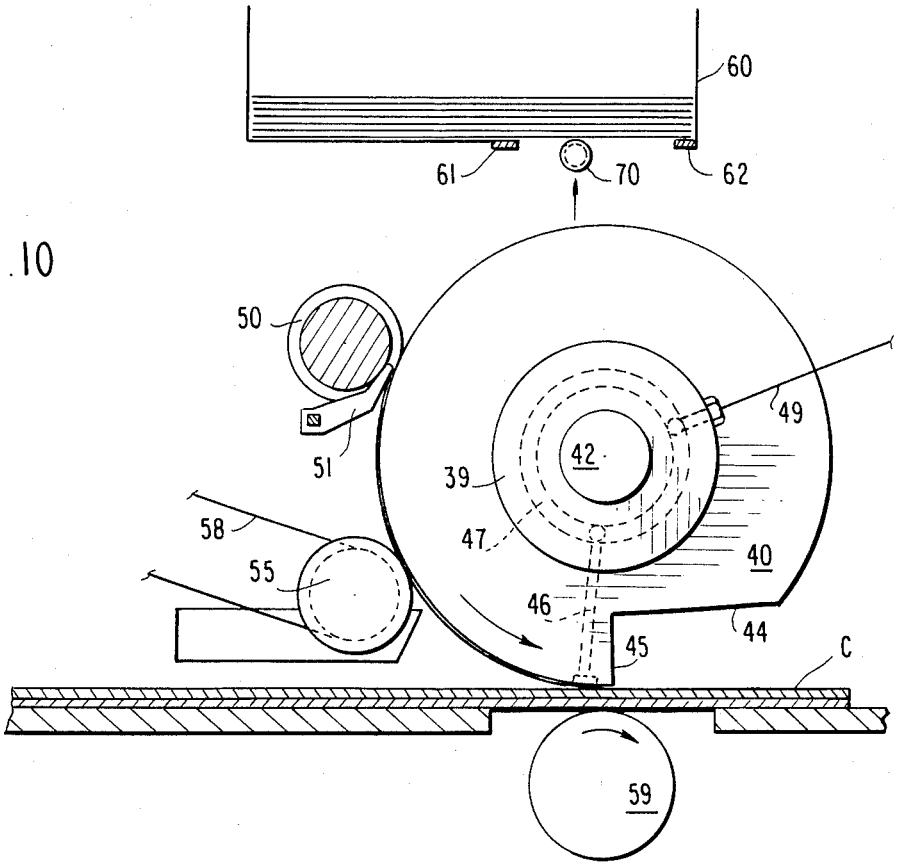
Figure 11:
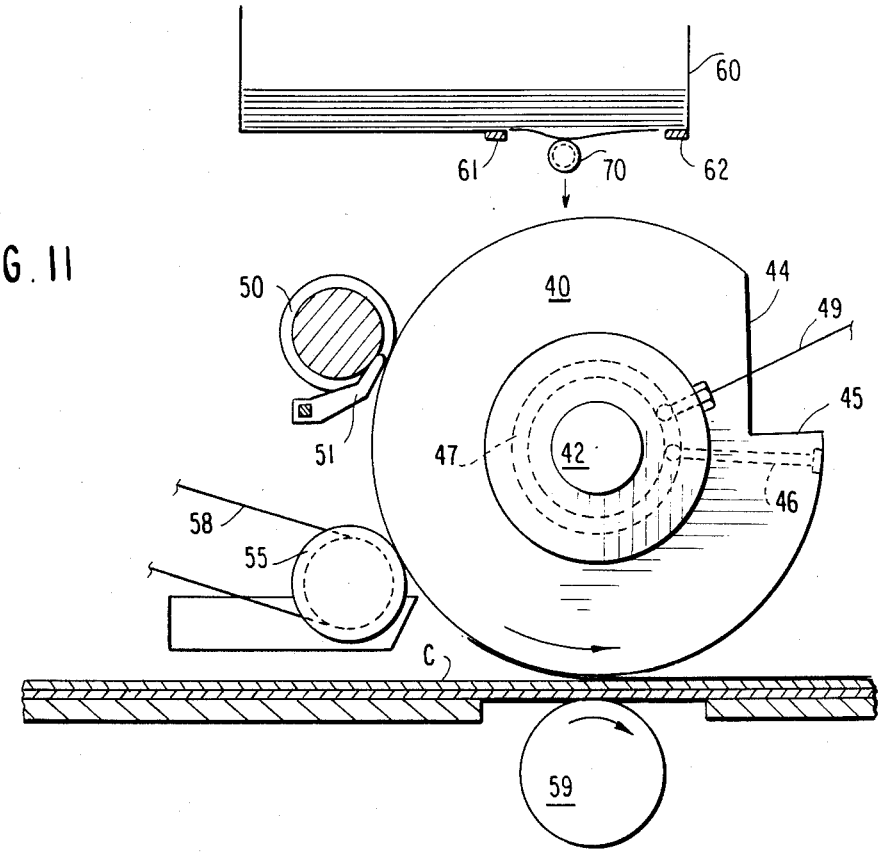

FIGS. 4 through 11 sequentially illustrate the operation of the label transfer assembly. In FIG. 4, the picker bar has vacuum gripped a label end portion and drawn it down toward the surface of applicator drum 40 as the drum notch abutment face 45 approaches the label edge. FIG. 5 shows the picker bar 70 in lowermost position with the label edge penetrating the applicator drum notch space and the abutment face 45 at contact with the label edge. Further rotation shown by FIG. 6 has the label edge sliding radially inward along the abutment face and bending over the radius of picker bar 70. In FIG. 7, the label has been curled about the surface of picker bar 70 and the label top face secured to the drum perimeter by the vacuum ports 46. By the strength of such vacuum adhesion, the label is shown by FIG. 8 to be drawn over picker bar 70 past the magazine bottom edge 61. FIG. 9 shows the label as completely extracted from the magazine and wiped lightly to the applicator drum surface by pressure roll 50. The label leading edge approaches the fountain roll 55 to receive a measured application of water or adhesive coating on the label underside. The leading edge of carton C approaches the nip between applicator drum and pressure roll 59. In FIG. 10, pressure roll 59 has resiliently retreated from the applicator drum to allow the carton C to penetrate the nip therebetween. Continued rotation of the applicator drum brings the adhesive coated leading edge of the label into nip loaded contact with the carton surface. Picker bar 70 has returned to its upper position in contact with the lower, back surface of the next bottom-most label. FIG. 11 shows the first label in substantially complete contact application on the carton C and the next label at the initial magazine withdrawal position by picker bar 70.

Having fully described our invention and its operation, other uses and alternative subcombinations will readily occur to those of ordinary skill in the art.

As our invention, therefore, we claim:

1. An apparatus for transferring label sheets from a supply magazine to the surface of a substrate article comprising:

label magazine means for confining a stack of label sheets having outer faces and inner faces, respectively, said labels being stacked in said magazine with the inner face toward a bottom end of said magazine, said bottom end having a partially open area for withdrawal of a label sheet therefrom;

oscillating picker means for gripping the inner face of the bottom-most label sheet near one end thereof in the region of said partially open magazine bottom area at one oscillatory limit whereby said one end of said label sheet is drawn through said open area as said picker means is moved away from said magazine toward an opposite oscillatory limit;

rotatively driven applicator roll means having a substantially continuous cylindrical perimeter surface interrupted by one notch means projecting radially into said surface and extended axially across said surface, said applicator roll means including label sheet vacuum gripping means within said applicator roll positioned along a line parallel with and adjacent to an abrupt edge in said surface respective to said notch means, said magazine means, picker means and applicator roll means being relatively positioned and operatively timed whereby said picker means places said one end of said label sheet into the rotating notch means at an opposite oscillatory limit of said picker means for abutment by said abrupt edge and reversal of said label sheet into outer face contact with said applicator roll surface, said label sheet being held to said applicator roll surface by said vacuum gripping means to be completely withdrawn from said magazine by continued rotation of said applicator roll;

end-less conveyor means for movement of an article past and proximate of the perimeter of said rotating applicator roll for receipt of said label sheet from said applicator roll; and, timing means for coordinating the label sheet delivery position of said applicator roll to the article reception position of said conveyor means.

2. An apparatus as described by claim 1 comprising fountain roll means located angularly about the rotational circle of said applicator roll means between said picker means and the proximity position with said conveyor means for liquid coating said label inner face whereby said label sheet is transferred from said applicator roll surface to said article by adhesive contact.

3. An apparatus as described by claim 2 wherein said liquid coating applied to said label inner face is water to activate a previously applied dry adhesive coating on said inner face.

4. An apparatus as described by claim 2 wherein said liquid coating applied to said label inner face is liquid phase adhesive.

5. An apparatus as described by claim 1 comprising a drive shaft source of rotary power common to said applicator roll means and said conveyor means, said timing means comprising clutch means for selectively interrupting the power transmission between said common drive shaft and said applicator roll means.

6. An apparatus as described by claim 5 wherein said clutch means comprises a pair of one-way drive clutches disposed axially side-by-side in opposite-hand drive orientation, said pair of one-way clutches being drivingly secured within a chain drive sprocket hub, and an axially slidable shaft collar rotatively secured to said common drive shaft, said shaft collar having at least two, axially adjacent, outside diameter surface portions, the first such surface portion having a clutch driving engagement diameter and the second such surface portion having a clutch disengagement diameter.

7. A folded carton labeling machine having magazine supply means for sheet labels and folded cartons, respectively, said machine comprising a sheet label transfer means for serially transferring a single label sheet from the bottom of a label magazine supply stack to a respective folded carton withdrawn by endless conveyor means from the bottom of a carton magazine supply stack, said label transfer means comprising oscillating picker means having vacuum holding means for attachment to an underside label face of the bottommost sheet label in said label supply stack to draw one end thereof away from the stack remainder and position said one end into a single notch in the rotating cylindrical surface of said applicator roll having a label edge abutment surface for face reversal by further rotation of said applicator roll, vacuum holding means in said applicator roll to secure an outer face of said label to the surface of said applicator roll whereby said underside face of said label is positioned away from said applicator roll surface and said label is withdrawn from said magazine by further applicator roll rotation, substantially equally spaced lug means distributed around and secured to the perimeter of said conveyor means for driving a single folded carton from under said carton stack into label receptive proximity with said applicator roll means and clutch means for coordinating an angular position of said applicator roll means with a linear position of said conveyor means.

8. A machine as described by claim 7 wherein said oscillating picker means is displaced between oscillation limits by a cam lobe portion of an applicator roll drive, said applicator roll drive being selectively linked to a conveyor drive by said clutch means.

9. A machine as described by claim 7 comprising independently driven fountain roll means located around the rotational circle of said rotating applicator roll means between a label reception position and a label delivery position for moistening an adhesive coating on said label underside face.

10. A machine as described by claim 7 comprising independently driven fountain roll means located around the rotational circle of said rotating applicator roll means between a label reception position and a label delivery position for applying an adhesive coating on said label underside face.

* * * * *